US009425544B2

(12) United States Patent
Murakami et al.

(10) Patent No.: US 9,425,544 B2
(45) Date of Patent: Aug. 23, 2016

(54) ELECTRIC POWER TAKEOUT DEVICE

(71) Applicant: HONDA MOTOR CO., LTD., Tokyo (JP)

(72) Inventors: Hiroko Murakami, Wako (JP); Takayuki Komatsu, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/876,977

(22) Filed: Oct. 7, 2015

(65) Prior Publication Data

US 2016/0141794 A1 May 19, 2016

(30) Foreign Application Priority Data

Nov. 14, 2014 (JP) ..... 2014-231311

(51) Int. Cl.
*H01R 13/44* (2006.01)
*H01R 13/52* (2006.01)

(52) U.S. Cl.
CPC ..... *H01R 13/5213* (2013.01); *H01R 13/5208* (2013.01)

(58) Field of Classification Search
CPC ..... H01R 13/447; H01R 13/5227
USPC ..... 439/144, 142, 206, 371, 373; 174/67; 220/242
See application file for complete search history.

(56) References Cited

U.S. PATENT DOCUMENTS 3,189,212 A * 6/1965 Bellek ..... H01R 13/447 174/67
3,639,886 A * 2/1972 Drapkin ..... H01R 13/5213 174/66
3,686,425 A * 8/1972 Zerwes ..... H02B 1/44 174/53
4,031,312 A * 6/1977 Coleman ..... H05K 5/061 174/135
4,109,095 A * 8/1978 Kling ..... H02G 3/14 174/67
4,381,063 A * 4/1983 Leong ..... H02B 1/066 174/67
4,505,403 A * 3/1985 Bowden, Jr. ..... H02B 1/066 174/67
4,546,418 A * 10/1985 Baggio ..... H02B 1/50 361/652
4,994,631 A * 2/1991 Williams, Jr. ..... H02G 3/14 174/67

(Continued)

FOREIGN PATENT DOCUMENTS

JP 3135963 9/2007

*Primary Examiner* — Neil Abrams
(74) *Attorney, Agent, or Firm* — Rankin, Hill & Clark LLP

(57) ABSTRACT

An electric power takeout device includes a protruding wall protruding in such a manner as to surround an electric power takeout section, and a cover covering the protruding wall and the power takeout section. The cover includes a cover wall covering the power takeout section with its outer peripheral edge opposed to the distal end edge of the protruding wall, and a peripheral wall protruding from the outer peripheral edge of the cover wall along the protruding wall, the peripheral wall being spaced a given distance from the body to thereby define a water introduction port above the protruding wall. The cover wall has a water discharge port communicating with the water introduction port and opening beneath the protruding wall, and a water guide section extending from the lower edge of the water discharge port to beneath the protruding wall.

4 Claims, 13 Drawing Sheets

(56) References Cited

U.S. PATENT DOCUMENTS 5,202,538 A * 4/1993 Skirpan ..... H02B 1/52 174/661
5,255,965 A * 10/1993 Chen ..... A47B 81/06 16/260
5,280,135 A * 1/1994 Berlin ..... H02G 3/14 174/67
5,527,993 A * 6/1996 Shotey ..... H02G 3/088 174/67
5,800,188 A * 9/1998 Barber ..... B60D 1/64 220/242
5,876,243 A * 3/1999 Sangawa ..... H01H 9/04 200/51 R
6,312,035 B1 * 11/2001 Aoki ..... B60L 11/1818 16/361
6,462,277 B1 * 10/2002 Young ..... H02G 3/185 174/66
6,919,510 B1 * 7/2005 Chen ..... H05K 5/061 174/17 CT
6,951,081 B2 * 10/2005 Bonshor ..... H02G 3/088 52/302.1
7,151,221 B1 * 12/2006 Backofen ..... H02G 3/088 174/66
7,648,043 B2 * 1/2010 Chen ..... B60R 11/02 174/66
7,993,158 B2 * 8/2011 Kang ..... F25D 23/00 312/401
8,013,245 B2 * 9/2011 Korcz ..... H02B 1/52 174/53
8,110,743 B2 * 2/2012 Drane ..... H02G 3/14 174/152 G
8,367,926 B2 * 2/2013 Peng ..... H01R 13/5213 174/17 R
8,530,757 B2 * 9/2013 Dinh ..... H02G 3/088 174/481
8,827,731 B2 * 9/2014 Sasaki ..... B60L 11/1818 439/206
9,147,960 B2 * 9/2015 Kojima ..... H01R 13/447
9,166,337 B2 * 10/2015 Boswell ..... H01R 13/6395
9,276,346 B1 * 3/2016 Czarnecki ..... H01R 13/447

* cited by examiner

ELECTRIC POWER TAKEOUT DEVICE

FIELD OF THE INVENTION

The present invention relates to an electric power takeout device provided in a power supply apparatus, such as an electric power conversion apparatus, and including an electric power takeout section.

BACKGROUND OF THE INVENTION

Among the conventionally-known electric power takeout devices of power supply apparatus is one disclosed in Japanese Utility Model Registration No. 3135963 (hereinafter referred to as the "relevant patent literature"), which includes an electric power takeout section for taking out electric power from the body of the power supply apparatus, and in which the electric power takeout section is covered with a cover that is in turn covered with a door. The door covering the cover can prevent rainwater etc. from being adhered to the cover.

However, with the electric power takeout device disclosed in the relevant patent literature, which requires two members, i.e. the cover and the door, in order to prevent rainwater etc. from entering the electric power takeout section, the number of necessary component parts increases, which would hinder reduction of cost.

SUMMARY OF THE INVENTION

In view of the foregoing prior art problems, it is an object of the present invention to provide an improved electric power takeout device which can prevent, by means of a single cover, rainwater etc. from entering the electric power takeout section.

In order to accomplish the above-mentioned object, the present invention provides an improved electric power takeout device for use in a power supply apparatus for taking out electric power from the power supply apparatus, which comprises: a protruding wall provided on and protruding from a body of the power supply apparatus in such a manner as to surround an electric power takeout section of the electric power takeout device; and a cover covering the protruding wall and the electric power takeout section, the cover including: a cover wall covering the electric power takeout section and having an outer peripheral edge opposed to a distal end edge of the protruding wall; and a peripheral wall protruding from the outer peripheral edge of the cover wall along the protruding wall, the peripheral wall being spaced a given distance from the body to thereby define a water introduction port above the protruding wall, the cover wall having: a water discharge port communicating with the water introduction port and opening beneath the protruding wall; and a water guide section extending from the lower edge of the water discharge port to beneath the protruding wall.

According to the present invention, the electric power takeout section is surrounded by the protruding wall provided on the apparatus body, and the protruding wall and the electric power takeout section are covered with the cover. The cover includes the cover wall and the peripheral wall, and the water introduction port is defined by the peripheral wall of the cover and the apparatus body above the protruding wall. Further, the cover wall has the water guide section and the water exhaust port that is provided in communication with the water introduction port and opens beneath the protruding wall. Further, the water guide section extends from the lower edge of the water exhaust port to beneath the protruding wall.

With such arrangements, water (e.g., rainwater) flows into between the protruding wall and the peripheral wall of the cover, and the water having thus flown into between the protruding wall and the peripheral wall is directed to the distal end of the protruding wall. The thus-directed water drops from the distal end of the protruding wall to the water discharge port and then is discharged through the water discharge port to the outside. In this way, the present invention can prevent, by means of the single cover, unwanted entry of water into the electric power takeout section, with the result that the electric power takeout device can be reduced in cost.

Further, because rainwater having entered through the water introduction port is discharged through the water discharge port to the outside, the present invention can eliminate the need to seal between the apparatus body and the cover by means of a seal material. Thus, it is possible to eliminate the need for such a seal material and thereby further reduce the cost.

If sealing is made between the apparatus body and the cover by means of a seal material to prevent entry of water, there is a need to shape the case and the cover with a high accuracy, which would undesirably hinder reduction of the cost of the apparatus body and the cover (and hence the cost of the power supply apparatus). By contrast, in the present invention, where entry of water into the electric power takeout device is prevented with a gap defined between the apparatus body and the cover, it is possible to considerably lower the shaping accuracy of the apparatus body and the cover to some degree, which can significantly facilitate the manufacturing of the apparatus body In a referred embodiment, the cover wall has a projection projecting from a position of the water guide section, overlapping the protruding wall in a vertical or up-down direction, toward the protruding wall. Thus, it is possible to prevent, by the projection, water, having dropped from the distal end of the protruding wall, from entering the electric power takeout device. In this way, the present invention can reliably direct the water, having dropped to the water guide section, to the water discharge port and discharge the water to the outside via the water discharge port.

In a preferred embodiment, the water guide section extends in a downward slope from the protruding wall toward the water discharge port. Thus, the present invention can prevent, by means of the water guide section, water, having dropped from the distal end of the protruding wall to the water discharge port, from entering the electric power takeout section. In this way, the present invention can reliably direct the water, having dropped to the water guide section, to the water discharge port and discharge the water to the outside through the water discharge port.

In a preferred embodiment, the cover wall has an insertion opening formed in a portion thereof corresponding to an electrical receptacle of the electric power takeout device, and the cover includes an elastically deformable, electric cable seal section, the electric cable seal section covering the insertion opening and having a slit or an superimposed portion which an electric cable to be connected to the receptacle can be passed through. Thus, with an electric cord not inserted or passed through the slit or the superimposed portion of the electric cable seal section, it is possible to cover the insertion opening with the electric cable seal section and thereby prevent water from entering the electric power takeout section through the insertion opening. With an electric cord is inserted or passed through the slit or the superimposed portion of the electric cable seal section, on the other hand, the electric cable seal section elastically deforms due to the passage therethrough of the electric cord, and such elastic deformation can minimize a gap that would be formed between the electric cord and a portion of the seal section defining the slit. In this way, the present invention can prevent water from entering the electric power takeout section through the gap that would be formed between the electric cord and the portion of the seal section defining the slit.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

Now, a description will be given about an embodiment of an electric power takeout device 15 of the present invention.

Figure 1:
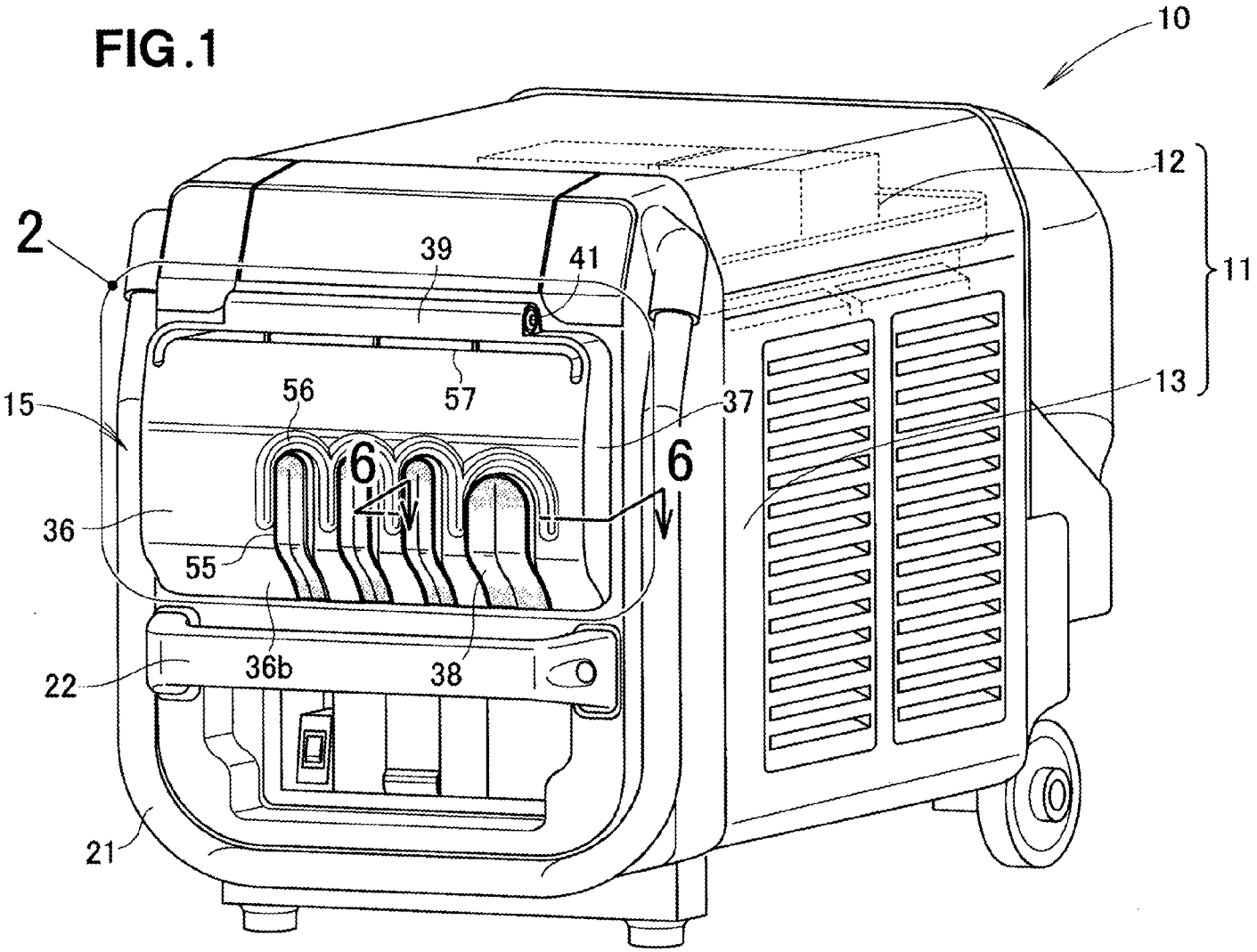
FIG. 1 is a perspective view of a power supply apparatus provided with an embodiment of an electric power takeout device of the present invention.

An electric power supply apparatus 10 shown in FIG. 1 is a DC-AC conversion apparatus which includes: an apparatus body 11 for converting DC electric power generated in a fuel cell vehicle or the like into AC electric power; the electric power takeout device 15 provided in the apparatus body 11; a towing handle 21 provided on the apparatus body 11; and a carrying grip 22. The electric power takeout device 15 will be described hereinbelow in relation to a case where an apparatus that generates DC electric power is a fuel cell vehicle, a plug-in hybrid vehicle, or the like.

Figure 2:
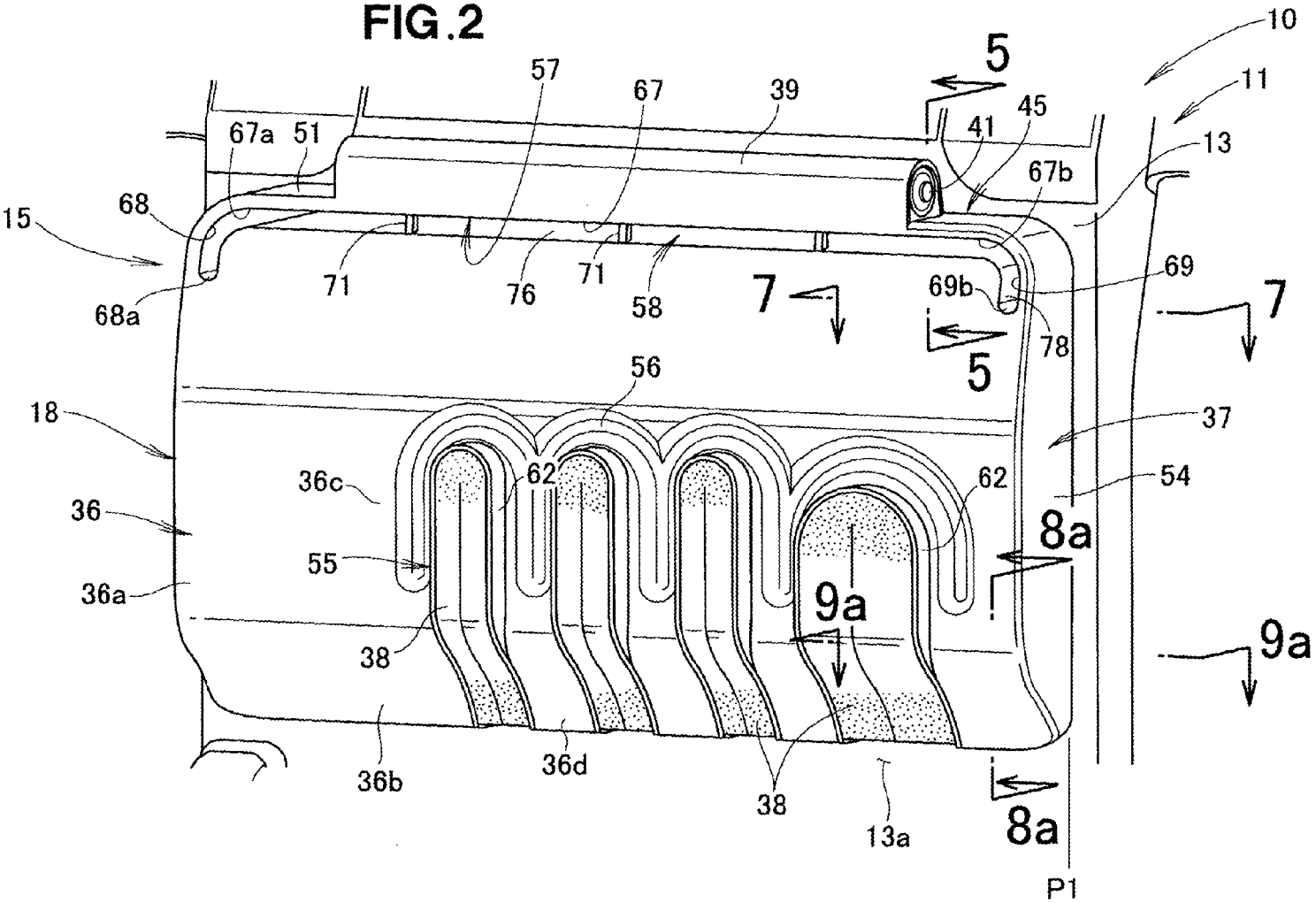
FIG. 2 is an enlarged fragmentary view of a section enclosed at 2 in FIG. 1.
Figure 3:
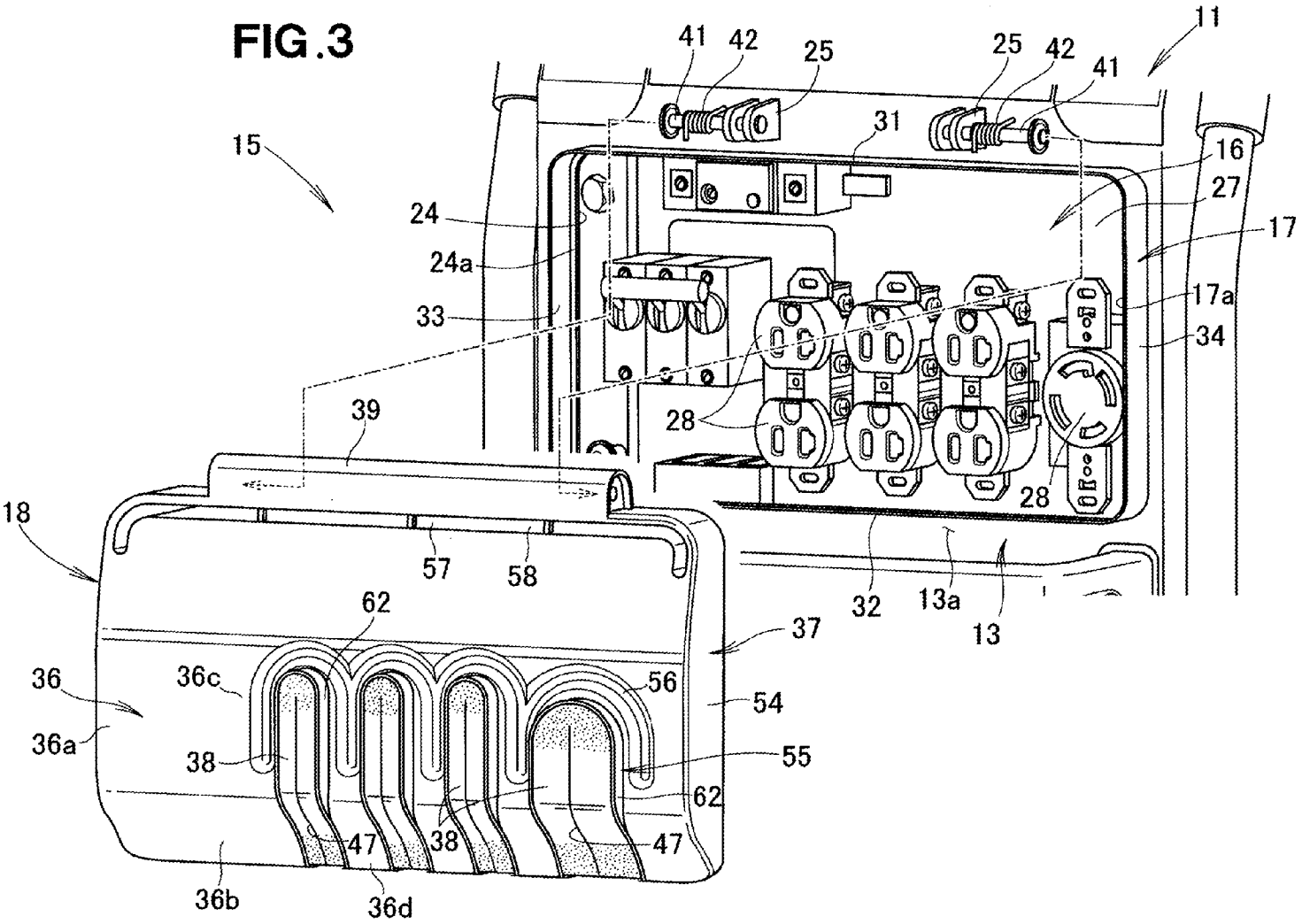
FIG. 3 is an exploded perspective view showing the electric power takeout device of FIG. 2 with a cover detached.

As shown in FIGS. 2 and 3, the electric power takeout device 15 includes: an electric power takeout section 16 provided on the apparatus body 11; a wall 17 protruding so as to surround the electric power takeout section 16; and a cover 18 covering the electric power takeout section 16.

The apparatus body 11 includes a conversion unit 12 (see FIG. 1) for connection to a plurality of output electrical receptacles (hereinafter "outlet receptacle") 28 of the electric power takeout section 16, and a case 13 for housing the conversion unit 12.

The case 13 has an opening section 24 of a generally rectangular shape formed in a position corresponding to the electric power takeout section 16, and a pair of cover support sections 25 formed immediately above the opening section 24. Thus, the electric power takeout section 16 is exposed out of the case through the opening section 24.

Figure 6:
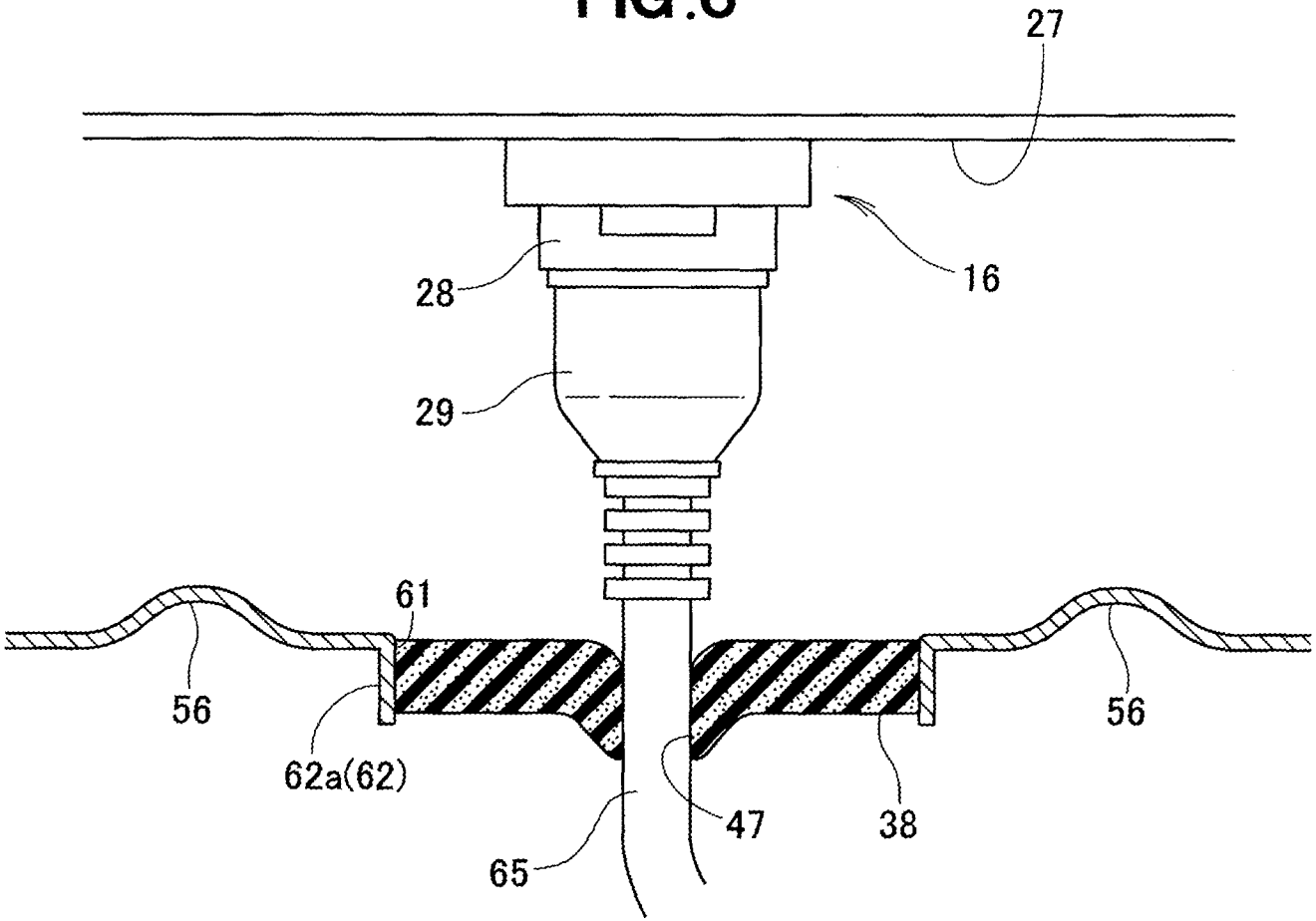
FIG. 6 is a sectional view taken along the 6-6 line of FIG. 1.

The electric power takeout section 16 includes an electric power takeout board 27 provided on a wall portion of the conversion unit 12, and the plurality of output receptacles 28 provided on the electric power takeout board 27. Plugs 29 (one of which is shown in FIG. 6) of domestic electric components, outdoor illumination, etc. are connectable to the output receptacles 28. Further, plugs of a fuel cell vehicle, a plug-in hybrid vehicle, etc. are connectable to input receptacles (not shown).

DC electric power is generated by any one of the fuel cell vehicle, the plug-in hybrid vehicle, etc. being driven in such conditions, and the DC electric power thus generated is introduced to the conversion unit 12 (see FIG. 1). The thus-introduced DC electric power is converted into AC electric power by the conversion unit 12, and the converted electric power is directed to one of the output receptacles 28.

The electric power directed to the output receptacle 28 as above is then directed to the domestic electric component, the outdoor illumination or the like via the plug 29 and an electric cable 65 (see FIG. 6). Namely, the AC electric power is directed from the electric power takeout section 16 to the domestic electric component, the outdoor illumination or the like.

Further, the electric power takeout section 16 is surrounded by the protruding wall 17 that protrudes from the peripheral edge 24*a* of the opening section 24 of the case 13 outward, i.e. toward the cover 18.

More specifically, the protruding wall 17 includes: an upper protruding wall portion 31 protruding substantially horizontally from an upper portion of the peripheral edge 24*a* of the opening section 24; a lower protruding wall portion 32 protruding substantially horizontally from a lower portion of the peripheral edge 24*a*; a left protruding wall portion 33 protruding substantially horizontally from a left side portion of the peripheral edge 24*a*; and a right protruding wall portion 34 protruding substantially horizontally from a right side portion of the peripheral edge 24*a*.

The protruding wall 17 is formed in a substantially rectangular frame shape along the opening peripheral edge 24*a* by the above-mentioned upper protruding wall portion 31, lower protruding wall portion 32, left protruding wall portion 33 and right protruding wall portion 34. In other words, the protruding wall 17 protrudes from the outer periphery of the electric power takeout section 16 in such a manner as to surround the electric power takeout section 16.

The electric power takeout section 16 and the protruding wall 17 are covered with the cover 18. The cover 18 includes: a cover wall 36 that covers the electric power takeout section 16, a peripheral wall 37 that protrudes from the outer peripheral edge 36*a* of the cover wall 36 along the protruding wall 17: a plurality of electric cable seal sections 38 provided on the cover wall 36; and a connection section 39 provided on an upper portion 51 of the peripheral wall 37.

The connection section 39 is pivotably supported by a pair of support sections 25 via a pair of support pins 41. A coil spring 42 is mounted on each of the support pins 41 so that the cover 18 is normally biased to a closed position P1 by the coil springs 42, in which condition the electric power takeout section 16 and the protruding wall 17 are covered with the cover 18.

Figure 4:
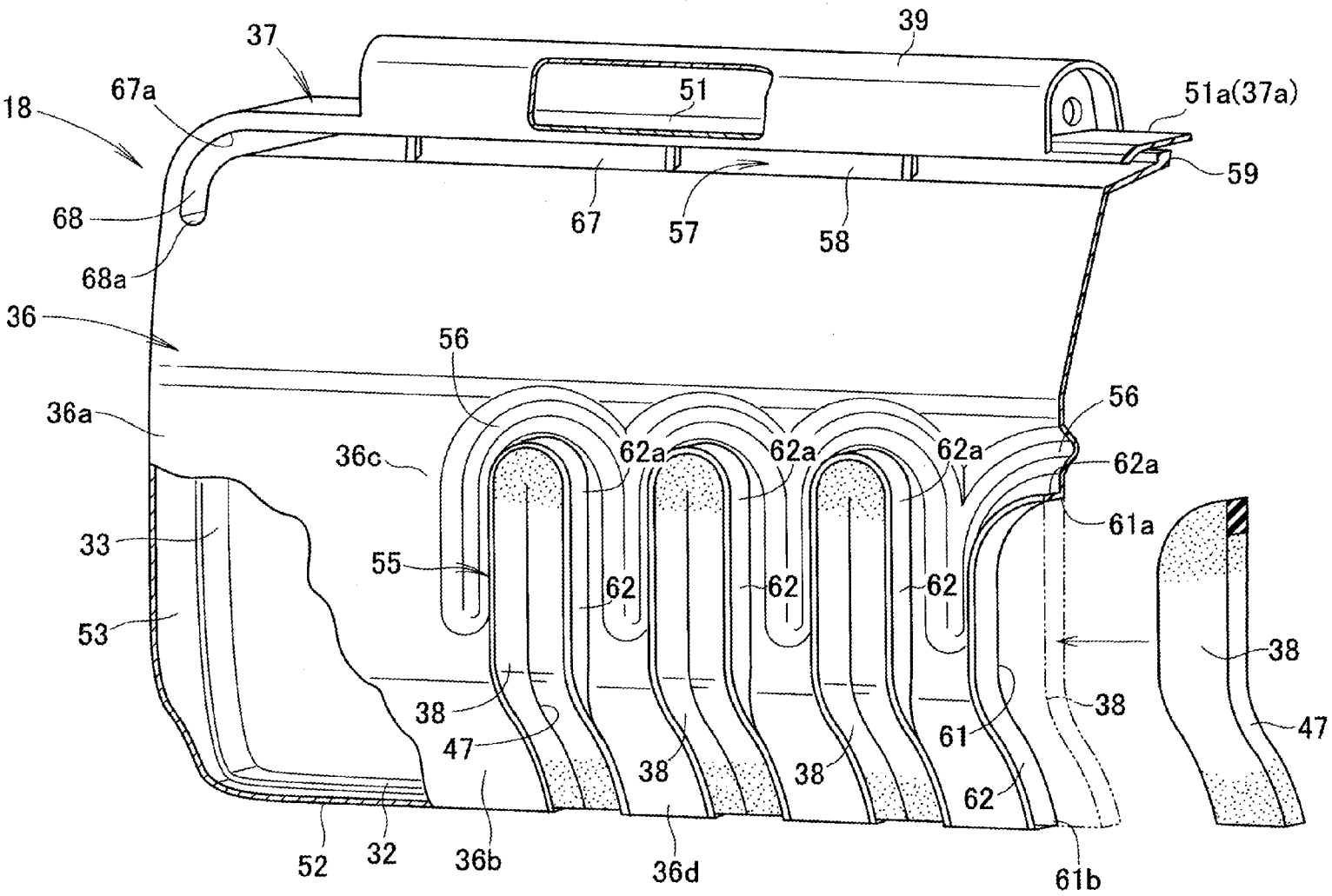
FIG. 4 is a partially-broken perspective view showing the cover of FIG. 3.
Figure 5:
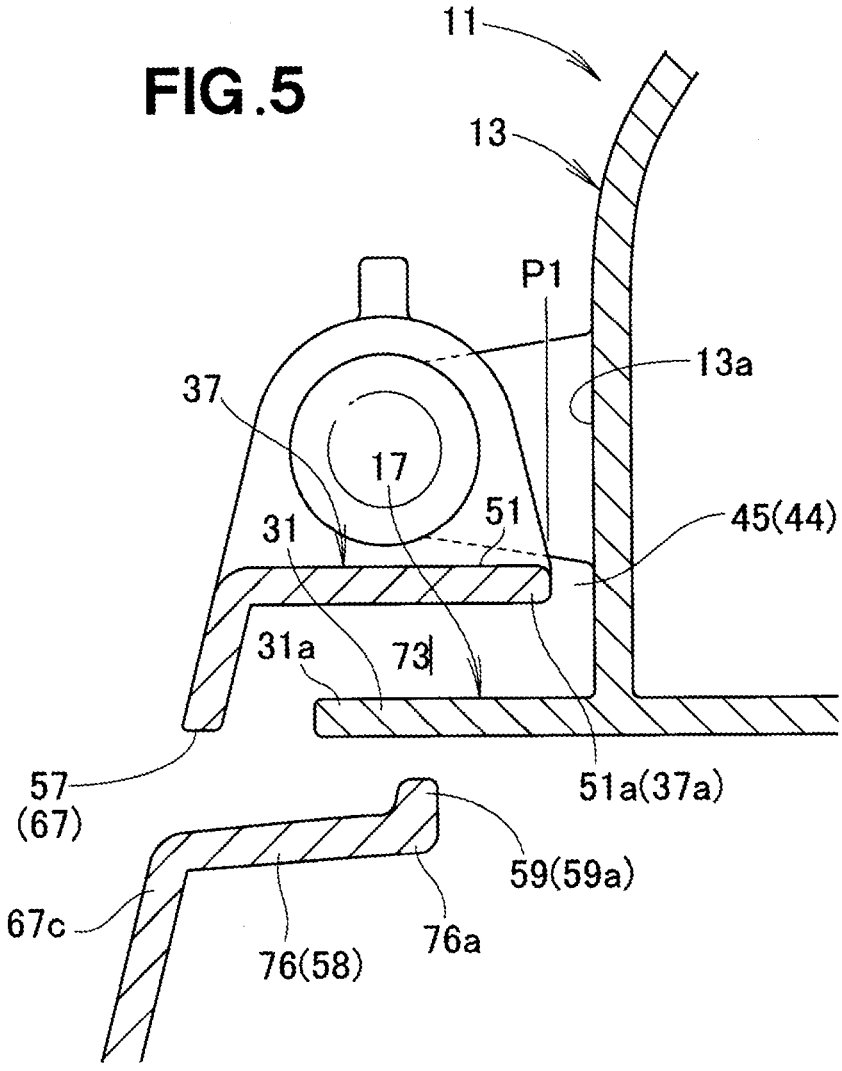
FIG. 5 is a sectional view taken along the 5-5 line of FIG. 2.

As shown in FIGS. 4 and 5, the peripheral wall 37 protrudes from the outer peripheral edge 36*a* of the cover wall 36 to extend along the protruding wall 17, and the peripheral wall 37 is formed in a substantially rectangular frame shape similarly to the protruding wall 17 (see also FIG. 3). The cover's peripheral wall 37 surrounds the protruding wall 17 from the outer peripheral side of the wall 17 when the cover 18 is maintained in the closed position P1 (FIG. 2).

With the peripheral wall 37 positioned so as to surround the protruding wall 17 from the outer peripheral side as noted above, the distal end edge 37*a* of the cover's peripheral wall 37 is spaced a slight distance from the surface 13*a* of the case 13 of the apparatus body 11, so that a gap 44 is formed between the distal end edge 37*a* of the cover's peripheral wall 37 and the surface 13*a* of the case 13.

The peripheral wall 37 of the cover 18 includes the upper peripheral wall portion 51, a lower peripheral wall portion 52, a left peripheral wall portion 53 and a right peripheral wall portion 54 (see FIG. 2). The upper peripheral wall portion 51 protrudes from an upper portion of the cover wall 36 to extend along the upper protruding wall portion 31 so that it is located over the upper protruding wall portion 31. The lower peripheral wall portion 52 protrudes from a lower portion of the cover wall 36 to extend along the lower protruding wall portion 32 so that it is located under the lower protruding wall portion 32.

Further, the left peripheral wall portion 53 protrudes from a left side portion of the cover wall 36 to extend along the left protruding wall portion 33 so that it is located to the left of the left protruding wall portion 33, and the right peripheral wall portion 54 protrudes from a right side portion of the cover wall 36 to extend along the right protruding wall portion 34 (see FIG. 3) so that it is located to the right of the left protruding wall portion 33.

To facilitate understanding, the construction of the instant embodiment will be described, assuming that, of the gap 44 between the distal end edge 37*a* of the peripheral wall 37 of the cover and the surface 13*a* of the case 13, a gap portion between the distal end edge 51*a* of the upper peripheral wall portion 51 and the surface 13*a* of the case 13 is a water introduction port 45. Namely, the water introduction port 45 is located above the upper protruding wall portion 31.

Referring back to FIG. 3, the cover wall 36, which is constructed to cover the electric power takeout section 16, is formed in a substantially rectangular shape as viewed in plan such that the outer periphery 36*a* of the cover wall 36 is opposed to the distal end edge 17*a* of the protruding wall 17. Further, a lower portion 36*b* of the cover wall 36 is formed in a concave shape substantially arcuately curved toward the electric power takeout section 16, so that a human operator's hand holding the grip 22 (see FIG. 1) can be prevented from contacting the lower portion 36*b* of the cover wall 36.

Further, as shown in FIGS. 3 and 5, the cover wall 36 includes: an electric cable insertion section 55 extending from a middle portion 36*c* of the cover wall 36 to the lower end 36*d* of the cover wall 36; beads 56 provided along the electric cable insertion section 55; a water discharge port 57 formed along an upper portion of the outer periphery 36*a*; a water guide section 58 protruding from the water discharge port 57 to the upper protruding wall portion 31 of the wall 17; and an upward projection 59 provided at the distal end of the water guide section 58.

Further, as shown in FIGS. 3 and 4, the electric cable insertion section 55 includes a plurality of insertion openings 61 extending from the middle portion 36*c* of the cover wall 36, and a plurality of ribs 62 formed along the periphery of the individual insertion openings 61. The insertion openings 61 are formed in positions of the cover all 36 that correspond to the plurality of output receptacles 28. More specifically, each of the insertion openings 61 is formed in a substantially U shape as viewed in plan, which has an upper end portion 61*a* formed in a semicircular shape and which opens at its lower end portion 61*b*.

The rib 62 formed along the peripheral edge of each of the insertion openings 61 has a substantially U shape as viewed in plan, and the rib 62 protrudes in a direction perpendicularly intersecting the general plane of the cover wall 36 with an upper half portion 62*a* of the rib 62 protruding outward from the cover wall 36. A portion of the electric cable insertion section 55 around each of the insertion openings 61 is reinforced with the rib 62 formed along the peripheral edge of the insertion opening 61. In this manner, a sufficient rigidity of the cover wall 36 (i.e., and hence the cover 18) can be secured by the provision of the ribs 62.

The electric cable seal sections 38 are joined to the inner surfaces of the substantially-U-shaped ribs 62 by adhesive so that the insertion openings 61 are covered with the electric cable seal sections 38. As an example, each of the electric cable seal sections 38 is formed of an elastic material that is generally used as seal members in automobiles etc. Each of the electric cable seal sections 38 has a slit 47 formed therein so that the electric cable (chord) 65 (see FIG. 6) can be passed through the slit 47.

By the plug 29 being connected to any one of the output receptacles 28, the corresponding electric cable 65 is inserted or passed through the slit 47 of the electric cable seal section 38, so that the electric cable seal section 38 elastically deforms. The elastic deformation of the electric cable seal section 38 can prevent a gap from being formed between the electric cable 65 and a portion of the seal section 38 defining the slit 47, and thus, the instant embodiment can prevent water (particularly, rainwater) from entering the electric power takeout section 16 through the gap between the electric cable 65 and the portion of the seal section 38 defining the slit 47.

The following description will be given in relation to a case where the water is rainwater.

With the plug 29 connected to the output receptacle 28, the plug 29 is covered with and protected by the cover 18, so that an enhanced usability of the electric power takeout device 15 can be achieved.

When the electric cable 65 (see FIG. 6) is not passed through the slit 47 of the electric cable seal section 38 as shown FIG. 4, on the other hand, the slit 47 is kept closed. Thus, the insertion opening 61 is covered or closed appropriately by the electric cable seal section 38, so that the instant embodiment can prevent rainwater from entering the electric power takeout section 16 (see FIG. 6) through the insertion opening 61.

Referring back to FIGS. 3 and 4, the plurality of insertion openings 61 are formed to open toward corresponding ones of the plurality of output receptacles 28 and covered by the corresponding electric cable seal sections 38. In this way, the plurality of output receptacles 28 can be used simultaneously, so that an enhanced usability of the electric power takeout device 15 can be achieved.

The bead 56 is formed to extend along and outward of the upper half portion 62*a* of each of the ribs 62 of the electric cable insertion section 55. The bead 56 is formed in a sectional shape substantially arcuately curved toward the electric power takeout section 16. Thus, portions around the insertion openings 61 are reinforced, and a sufficient rigidity of the cover wall 36 (i.e., cover) can be secured in a more appropriate manner.

Further, with the bead 56 formed to extend along and outward of the upper half portion 62*a* of each of the ribs 62 as above, rainwater directed by the bead 56 along the surface of the cover wall 36 can be directed downward along the bead 56. Thus, the rainwater on the surface of the cover wall 36 can be directed downward while avoiding the electric cable insertion section 55. Further, the upper half portion 62*a* of each of the ribs 62 protruding outward from the cover wall 36 can prevent the rainwater on the surface of the cover wall 36 from entering the insertion openings 61.

Namely, with the bead 56 formed to extend along and outward of the upper half portion 62*a* of each of the ribs 62 and with the upper half portion 62*a* of each of the ribs 62 protruding outward from the cover wall 36 as noted above, the instant embodiment prevent the rainwater on the surface of the cover wall 36 from entering the insertion openings 61.

Further, as shown in FIG. 2, the water discharge port 57, which is formed above the bead 56, comprises: a middle discharge port section 67 formed straight along an upper portion of the outer peripheral edge 36*a* of the cover wall 36; a left discharge port section 68 formed along a left upper corner portion of the outer peripheral edge 36*a*; and a right discharge port section 69 formed along a right upper corner portion of the outer peripheral edge 36*a*. A plurality of ribs 71 are formed at predetermined intervals on the middle discharge port section 67.

Further, as shown in FIG. 5, the middle discharge port section 67 is in communication with the water introduction port 45 defined between the upper peripheral wall portion 51 of the peripheral wall 37 and the surface 13*a* of the case 13. More specifically, with the upper peripheral wall portion 51 disposed over the upper protruding wall portion 31 in superimposed relation to the upper protruding wall portion 31, a space 73 is defined between the upper peripheral wall portion 51 and the upper protruding wall portion 31. The middle discharge port section 67 is in communication with the water introduction port 45 via the space 73.

Further, the middle discharge port section 67 opens at a position spaced outward from the distal end 31*a* of the upper protruding wall portion 31 and downward of the upper protruding wall portion 31 of the protruding wall 17. Namely, the middle discharge port section 67 is located beneath the space 73 defined between the upper peripheral wall portion 51 and the upper protruding wall portion 31.

Figure 7:
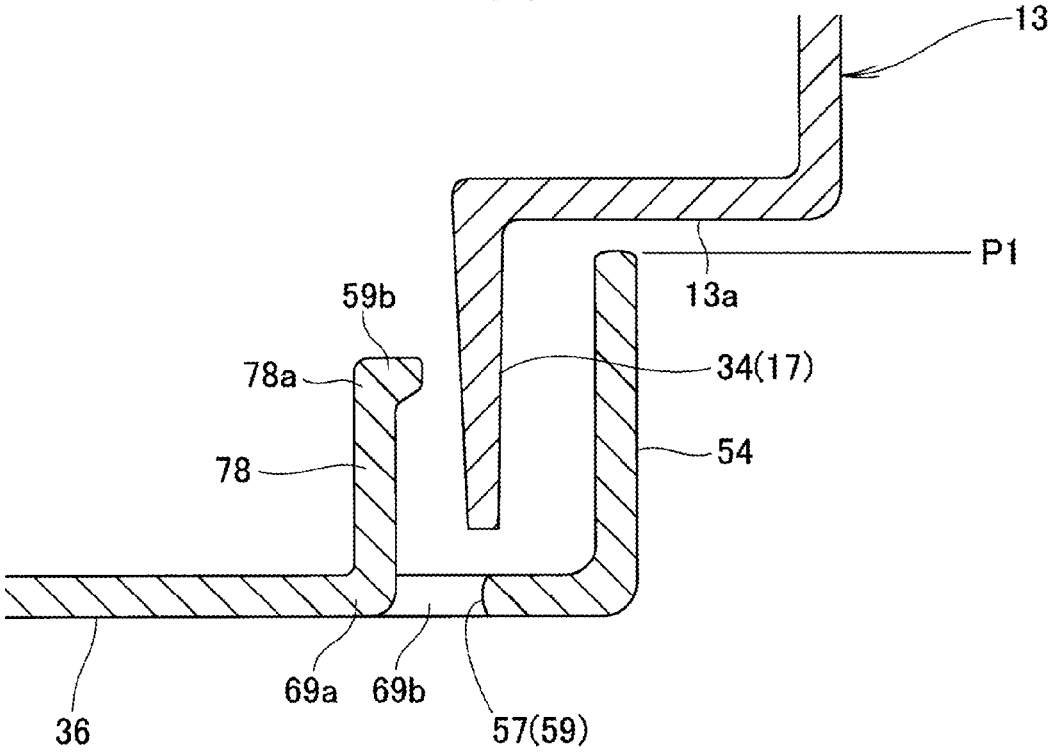
FIG. 7 is a sectional view taken along the 7-7 line of FIG. 2.

Further, as shown in FIGS. 2 and 7, the right discharge port section 69 of the water discharge port 57 extends downward from a right end portion 67*b* of the middle discharge port section 67. The right discharge port section 69 is located inward (i.e., to the left) of the right protruding wall portion 34 of the protruding wall 17. Similarly to the right discharge port section 69, the left discharge port section 68 of the water discharge port 57 extends downward from a left end portion 67*a* of the middle discharge port section 67. The left discharge port section 68 is an opening constructed in left-right symmetric relation to the right discharge port section 69, and thus, the following mainly describe in detail the right discharge port section 69 with a detailed description about the left discharge port section 68 omitted to avoid unnecessary duplication.

The water guide section 58, which protrudes from the water discharge port 57 to the upper protruding wall portion 31 of the wall 17, includes: a middle guide portion 76 provided in the middle discharge port section 67; a left guide portion (not shown) provided in the left discharge port section 68; and a right guide portion 78 provided in the right discharge port section 69.

Further, as shown in FIG. 5, the middle guide portion 76 extends in an ascending or upward slope from the lower edge 67*c* of the middle discharge port section 67 to beneath the upper protruding wall portion 31. In other words, the middle guide portion 76 is formed in a descending to downward slope from the upper protruding wall portion 31 of the protruding wall 17 toward the middle discharge port section 67. The middle guide portion 76 is located beneath the space 73.

The middle guide portion 76 is spaced downward from the upper protruding wall portion 31 of the protruding wall 17 by a predetermined distance. An upward projection 59*a* is formed at the distal end 76*a* of the middle guide portion 76. The distal end 76*a* of the middle guide portion 76 is a portion overlapping the protruding wall portion 31 of the protruding wall 17 in a vertical or up-down direction. Namely, the upward projection 59*a* projects from the distal end 76*a* of the middle guide portion 76 upward toward the protruding wall portion 31 of the protruding wall 17.

With the middle guide portion 76 located beneath the space 73 as noted above, rainwater entering the water introduction port 45 from the outside of the electric power takeout device 15 is directed via the space 73 to the middle guide portion 76. Then, the rainwater having been directed to the middle guide portion 76 is directed to the middle discharge port section 67 of the water discharge port 57 and thence discharged to the outside via the middle discharge port section 67.

Because the middle guide portion 76 is formed in a downward slope from the upper protruding wall portion 31 of the protruding wall 17 toward the middle discharge port section 67, the rainwater having dropped from the distal end 31*a* of the upper protruding wall portion 31 to the middle guide portion 76 can be prevented by the middle guide portion 76 from entering the electric power takeout section 16 (see FIG. 3).

Further, because the upward projection 59*a* is formed at the distal end 76*a* of the middle guide portion 76 and located inward of the distal end 31*a* of the upper protruding wall portion 31, the rainwater having dropped from the distal end 31*a* of the upper protruding wall portion 31 to the middle guide portion 76 can be prevented by the upward projection 59*a* from entering the electric power takeout section 16 (see FIG. 3).

Because the upward projection 59*a* is located inward of the distal end 31*a* of the upper protruding wall portion 31, i.e. at a position avoiding a rainwater flow path, a flow of the rainwater directed via the space 73 to the middle guide portion 76 can be prevented from being blocked by the upward projection 59*a*. In this way, the rainwater directed to the middle guide portion 76 can be appropriately directed to the middle discharge port section 67 and then discharged via the middle discharge port section 67 to the outside.

Namely, the electric power takeout device 15 constructed in the aforementioned manner can reliably direct the rainwater, having dropped to the middle guide portion 76, to the middle discharge port section 67 and discharge the directed rainwater to the outside via the middle discharge port section 67. Because the rainwater is discharged to the outside via the middle discharge port section 67, the electric power takeout device 15 can prevent the rainwater from entering the electric power takeout section 16.

Further, as shown in FIGS. 2 and 7, the right guide portion 78 of the middle guide section 76 extends downward from a right end portion 76*b* of the middle guide section 76. The right guide portion 78 extends from the inner edge 69*a* of the right discharge port section 69 to the right protruding wall portion 34 of the protruding wall 17. The right guide portion 78 is located inward (i.e., to the left) of the right protruding wall portion 34 of the protruding wall 17, and the right guide portion 78 is spaced a predetermined distance from the right protruding wall portion 34.

A rightward projection 59*b* is formed at the distal end 78*a* of the right guide portion 78. The distal end 78*a* of the right guide portion 78 is a portion overlapping the right protruding wall portion 34 in a left-right direction. Namely, the rightward projection 59*b* projects from the distal end 78*a* of the right guide portion 78 toward the right protruding wall portion 34. Rainwater directed to the right end portion 67*b* of the middle discharge port section 67 is directed downward along the right guide portion 78 and thence discharged to the outside via the lower end 69*b* of the right discharge port section 69.

The left guide portion and a leftward projection are constructed in left-right symmetric relation to the right guide portion 78 and the rightward projection 59*b*, and thus, the following mainly describe in detail the right guide portion 78 and the rightward projection 59*b* with a detailed description about the left guide portion and the leftward projection omitted to avoid unnecessary duplication.

With the left guide portion and the leftward projection, rainwater directed to the left end portion 67*a* of the middle discharge port section 67 is directed downward along the left guide portion and thence discharged to the outside via the lower end 68*a* of the left discharge port section 68.

The upward projection 59*a* of the middle guide portion 76, the rightward projection 59*b* of the right guide portion 78 and the leftward projection of the left guide portion are formed continuously, so that the projection 59 of the water guide section 58 is formed by the continuous upward projection 59*a*, rightward projection 59*b* and leftward projection.

As set forth above, rainwater entering the water introduction port 45 from the outside of the electric power takeout device 15 can be discharged to the outside through the water discharge port 57 (i.e., through the middle discharge port section 67, left discharge port section 68 and right discharge port section 69). Thus, unwanted entry of rainwater into the electric power takeout section 16 (see FIG. 3) can be prevented by the single cover 18, with the result that the electric power takeout device 15 (and hence the power supply apparatus 10) can be reduced in cost.

Because rainwater having entered through the water introduction port 45 is discharged via the water discharge port 57 to the outside, there is no need to seal between the case 13 of the apparatus body 11 and the cover 18 by means of a seal material. Thus, it is possible to eliminate the need for such a seal material and thereby further reduce the cost.

Figure 8A:
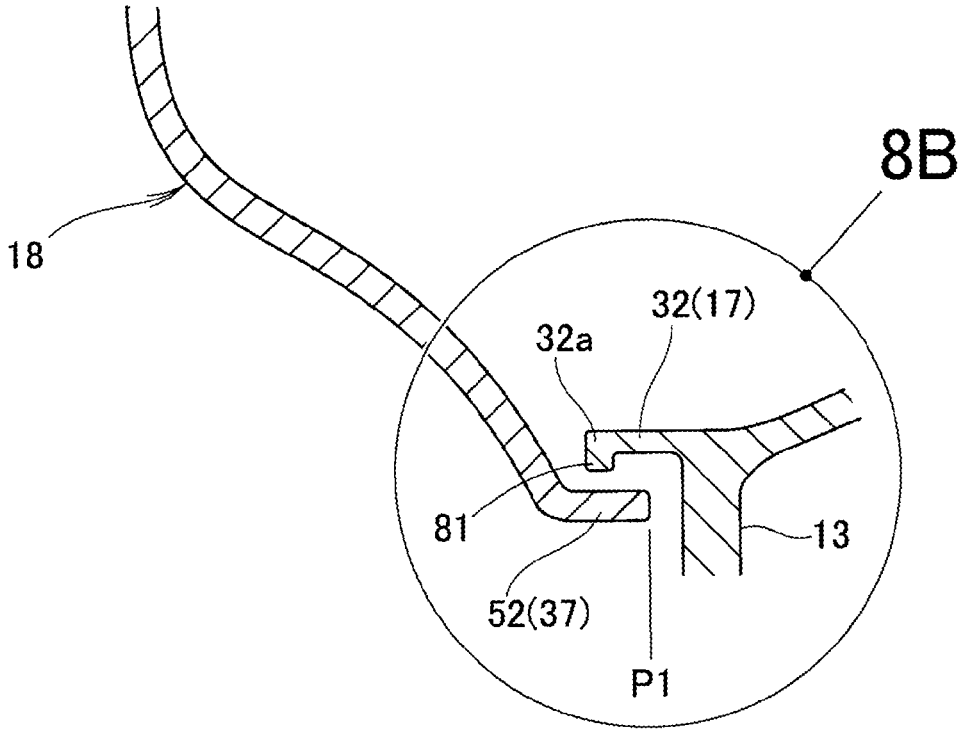
FIG. 8A is a sectional view taken along the 8*a*-8*a* line of FIG. 2.
Figure 8B:
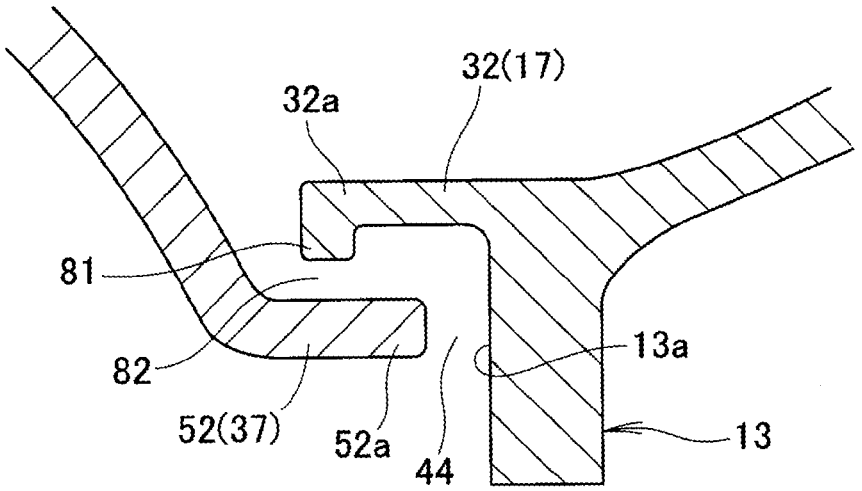
FIG. 8B is an enlarged view of a section encircled at 8*b* in FIG. 8A.

Further, as shown in FIG. 8, when the cover 18 is maintained in the closed position P1, the lower peripheral wall portion 52 is located beneath the lower protruding wall portion 32; thus, the lower peripheral wall portion 52 and the lower protruding wall portion 32 are located vertically superimposed on each other with an interval therebetween.

Further, a downward projection 81 is provided on the distal end 32*a* of the lower protruding wall portion 32; namely, the downward projection 81 projects from the distal end 32*a* of the lower protruding wall portion 32 downward toward the lower peripheral wall portion 52. The downward projection 81 is spaced from the lower peripheral wall portion 52 so that a gap 83 is defined between the lower protruding wall portion 32 and the lower peripheral wall portion 52. Further, with the cover 18 maintained in the closed position P1, the gap 44 is formed between the distal end edge 52*a* of the peripheral wall portion 52 of the cover 18 and the lower and the surface 13*a* of the case 13.

With the afore-mentioned arrangements, rainwater having entered the electric power takeout section 16 (see FIG. 3) can be discharged to the outside through the gap 82 and the gap 44. Further, a flow of rainwater having flown to between the peripheral wall portion 52 of the cover 18 and the lower protruding wall portion 32 can be blocked by the downward projection 81.

Figure 9A:
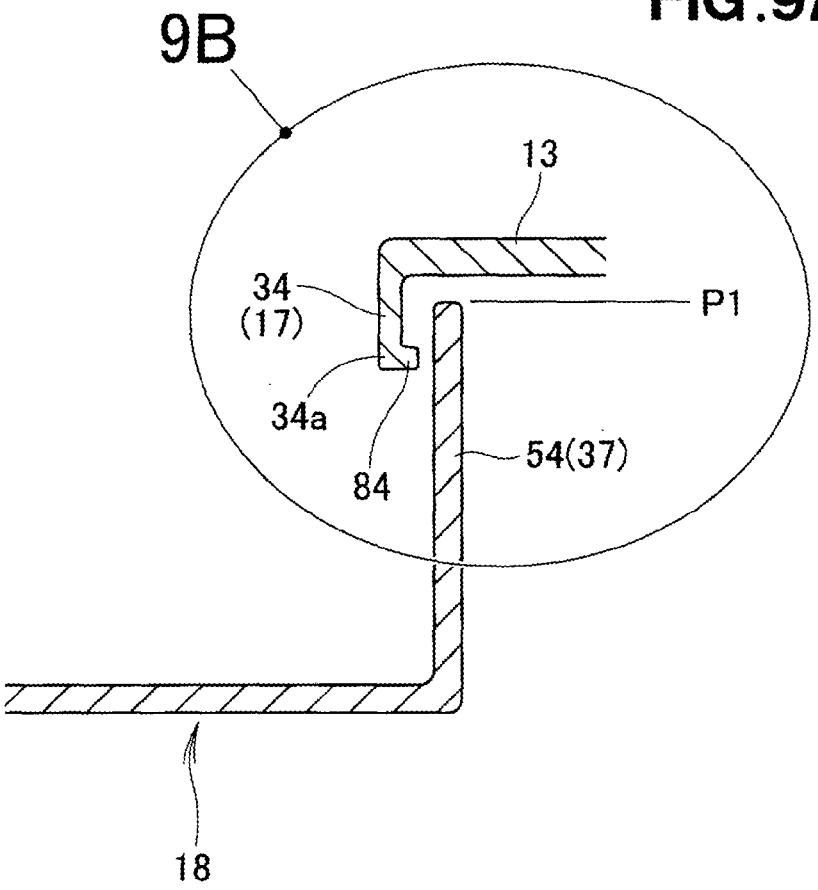
FIG. 9A is a sectional view taken along the 9*a*-9*a* line of FIG. 2.
Figure 9B:
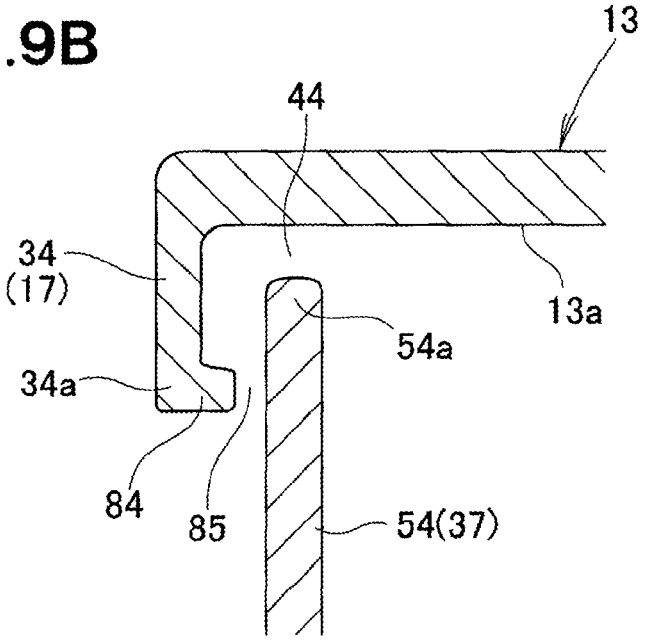
FIG. 9B is an enlarged view of a section encircled at 9*b* in FIG. 9A.

Further, when the cover 18 is maintained in the closed position P1, as shown in FIG. 9, the right peripheral wall portion 54 of the cover 18 is located to the right of the right protruding wall portion 34. Thus, the right peripheral wall portion 54 and the right protruding wall portion 34 are located superimposed on each other in the left-right direction with an interval therebetween.

Further, a rightward projection 84 is provided at the distal end 34*a* of the right protruding wall portion 34, and the right projection 84 projects from the distal end 34*a* of the right protruding wall portion 34 rightward toward the right peripheral wall portion 54 of the cover 18. The right projection 84 is spaced from the right peripheral wall portion 54 so that a gap 85 is defined between the right projection 84 and the right peripheral wall portion 54.

Further, with the cover 18 maintained in the closed position P1, the gap 44 is formed between the distal end edge 54*a* of the right peripheral wall portion 54 and the surface 13*a* of the case 13. A flow of rainwater having flown to between the right peripheral wall portion 54 of the cover 18 and the right protruding wall portion 34 can be blocked by the right projection 84 provided at the distal end 34*a* of the right protruding wall portion 34.

Referring now back to FIG. 4, the left protruding wall portion 33 of the protruding wall 17 and the left peripheral wall portion 53 of the peripheral wall 37 are constructed in left-right symmetric relation to the right protruding wall portion 34 of the protruding wall 17 and the right peripheral wall portion 54 of the peripheral wall 37, and thus, the following mainly describe in detail the right protruding wall portion 34 of the protruding wall 17 and the right peripheral wall portion 54 with a detailed description about the left protruding wall portion 33 and the left peripheral wall portion 53 omitted to avoid unnecessary duplication.

As a means for preventing entry of rainwater in the electric power takeout device 15, it is conceivable to seal between the case 13 of the apparatus body 11 and the cover 18 by means of a seal material. In such a case, however, there is a need to shape the case 13 and the cover 18 with a high accuracy in order to secure a sufficient sealing performance between the case 13 and the cover 18, which would hinder reduction of the cost of the case 13 and the cover 18 (and hence the cost of the electric power takeout device 15).

Therefore, the instant embodiment of the electric power takeout device 15 is constructed so that entry of rainwater into the electric power takeout section 16 can be prevented with the gap 44 defined between the case 13 and the cover 18. Thus, it is not necessary to shape the case 13 and the cover 18 with a high accuracy. In this manner, manufacturing of the case 13 and the cover 18 can be facilitated, and thus, the cost of the electric power takeout device 15 and the electric power supply apparatus 10 can be reduced.

The following describe, with reference to FIGS. 10 to 13, an example manner in which the electric power takeout section 15 is protected from rainwater. First, with reference to FIGS. 10 and 11, a description will be given about an example manner in which rainwater having flown to the water introduction port 45 defined between the upper peripheral wall portion 51 and the case 13 is discharged to the outside.

Figure 10A:
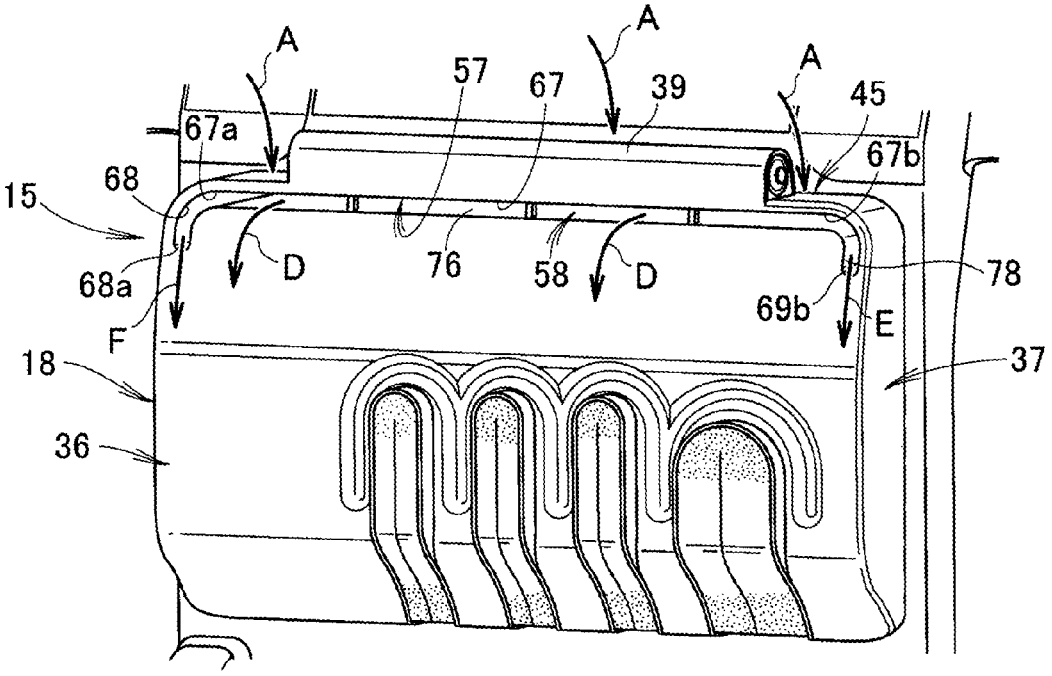
FIGS. 10A and 10B are a perspective view and a side view, respectively, explanatory of an example manner in which rainwater having flown into a water introduction port is discharged through a middle discharge port section of a water discharge port to the outside in the electric power takeout device.
Figure 10B:
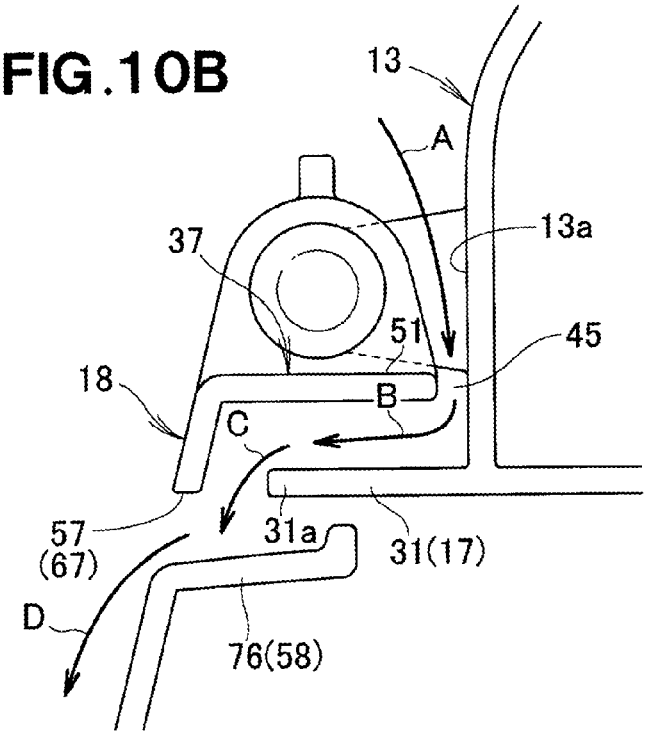

As shown in FIG. 10A, rainwater drops and flows into the water introduction port 45, from above the cover 18 (i.e., upper peripheral wall portion 51), as indicated by arrow A. Then, the rainwater having flown into the water introduction port 45 is directed along the upper protruding wall portion 31 to the distal end 31*a* as indicated by arrow B in FIG. 10B. The rainwater having been directed to the distal end 31*a* drops from the distal end 31*a* to the water guide section 58 as indicated by arrow C and then is directed to the water discharge port 57 (i.e., to the middle discharge port section 67). Then, the rainwater having been directed to the water discharge port 57 is discharged through the middle discharge port section 67 to the outside as indicated by arrow D (see also FIG. 10A).

Figure 11:
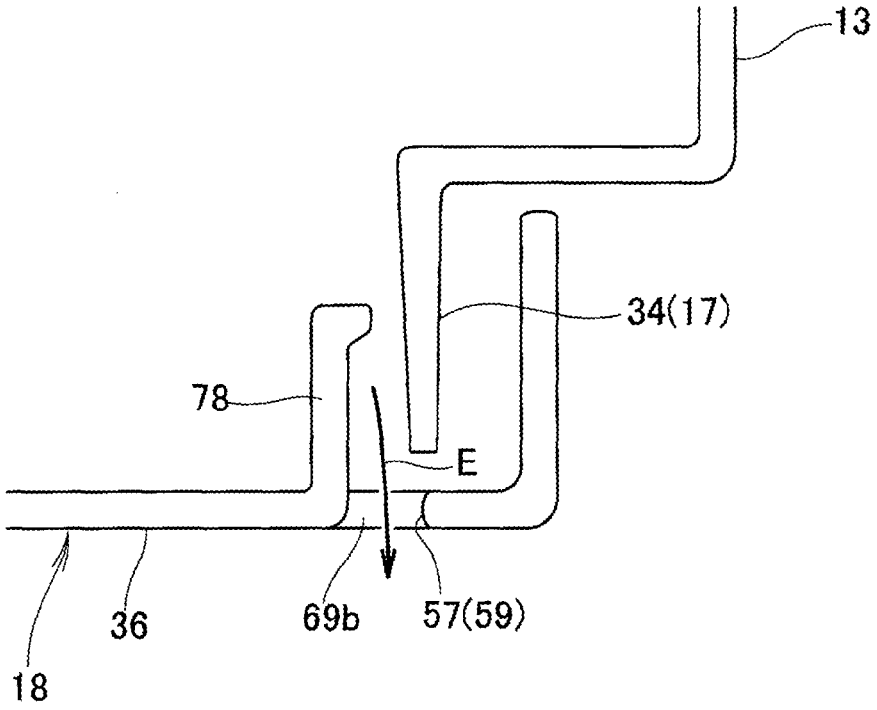
FIG. 11 is a view explanatory of an example manner in which rainwater having flown into the water introduction port is discharged through a right exhaust port section to the outside.

Then, the rainwater having been directed to the right end portion 67*b* of the middle discharge port section 67 flows down the right guide portion 78 as shown in FIG. 10A, after which the rainwater is discharged to the outside via the right discharge port section 69 (particularly, the lower end 69*b*) as indicated by arrow E in FIG. 11 (see also FIG. 10A).

Referring back to FIG. 10A, the rainwater having been directed to the left end portion 67*a* of the middle discharge port section 67 is also discharged to the outside via the left discharge port section 68 (particularly, the lower end 68*b*) as indicated by arrow F in FIG. 11, similarly to the rainwater having been directed to the right end portion 67*b* of the middle discharge port section 67. Thus, the rainwater can be appropriately discharged to the outside without staying at the left and right end portions 67*a* and 67*b* of the middle discharge port section 67.

In the aforementioned manner, the rainwater having flown into the water introduction port 45 from above the cover 18 can be appropriately discharged to the outside of the cover 18, so that the rainwater having flown into the water introduction port 45 can be prevented from entering the electric power takeout section 16 (see FIG. 3) and thus the electric power takeout section 16 can be protected from the rainwater.

Figure 12:
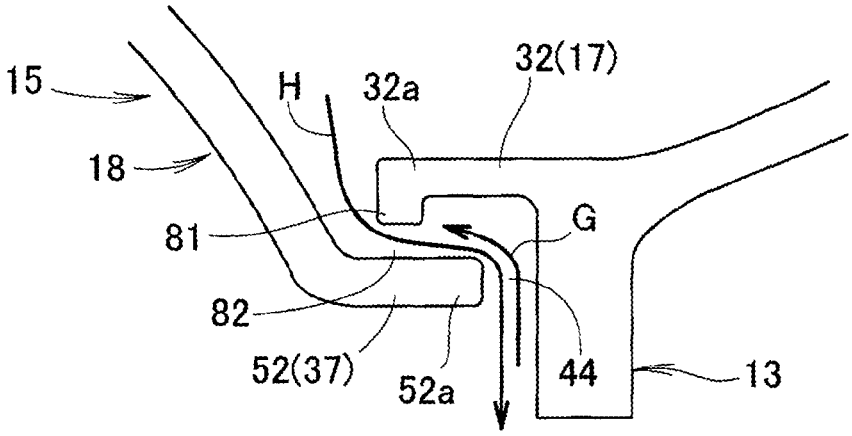
FIG. 12 is a view explanatory of an example manner in which rainwater is prevented from entering an electric power takeout section from below.

The following describe, with reference to FIG. 12, an example manner in which rainwater is prevented from entering the electric power takeout section 16 (see FIG. 3) from beneath the electric power takeout device 15. As shown in FIG. 12, the downward projection 81 is provided at the distal end 32*a* of the lower protruding wall portion 32, and thus, a flow of rainwater having flown to between the lower peripheral wall portion 52 of the cover 18 and the lower protruding wall portion 32 as indicated by arrow G can be blocked by the downward projection 81. Thus, the rainwater having flown to between the lower peripheral wall portion 52 of the cover 18 and the lower protruding wall portion 32 can be prevented by the downward projection 81 from entering the electric power takeout section 16.

Further, the gap 82 is formed between the downward projection 81 and the lower peripheral wall portion 52, so that the rainwater having entered the electric power takeout section 16 can be discharged to the outside as indicated by arrow H.

Figure 13:
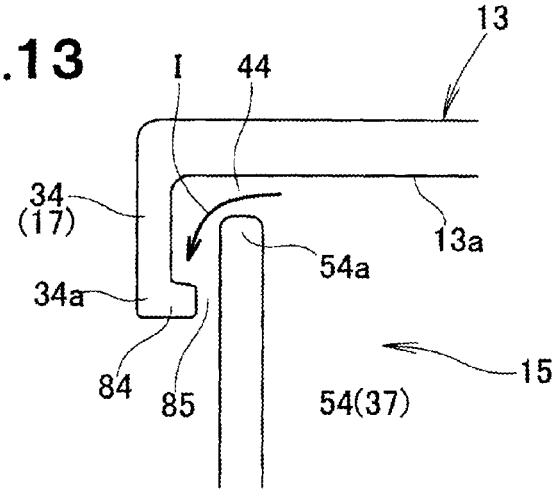
FIG. 13 is a view explanatory of an example manner in which rainwater is prevented from entering the electric power takeout section from a right side.

The following describe, with reference to FIG. 13, an example manner in which rainwater is prevented from entering the electric power takeout section 16 from the right side of the electric power takeout device 15. As shown in FIG. 13, the right projection 84 is provided at the distal end 34*a* of the right protruding wall portion 34, and thus, a flow of rainwater having flown to between the right peripheral wall portion 54 of the cover 18 and the right protruding wall portion 34 as indicated by arrow I can be blocked by the right projection 84. Thus, the rainwater having flown to between the right peripheral wall portion 54 of the cover 18 and the right protruding wall portion 34 can be prevented by the right projection 84 from entering the electric power takeout section 16.

Next, modifications 1 to 3 of the present invention will be described with reference to FIGS. 14 to 16.

Modification 1

Figure 14:
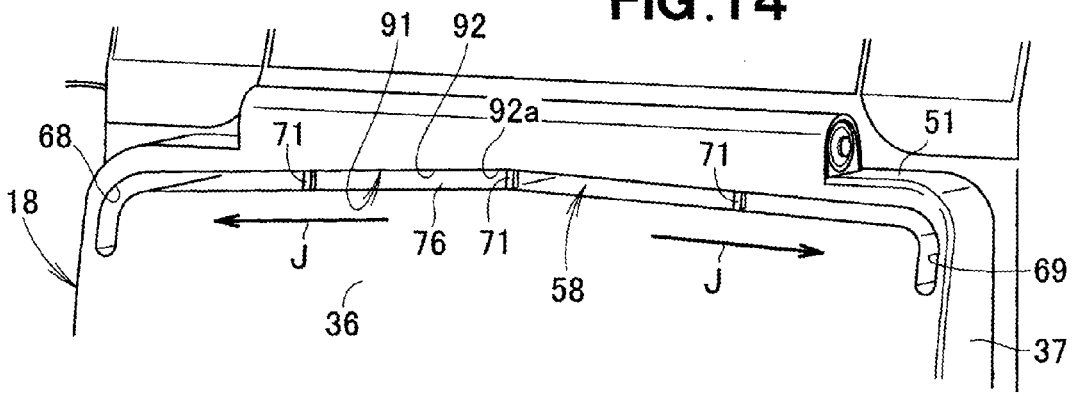
FIG. 14 is a perspective view showing modification 1 in which the water discharge port is formed in a chevron shape.

As shown in FIG. 14, modification 1 is characterized by replacing the water discharge port 57 provided in the above-described embodiment with a water discharge port 91. Specifically, whereas the water discharge port 57 in the above-described embodiment includes the middle discharge port section 67 extending horizontally in the left-right direction, the water discharge port 91 in modification 1 includes a middle discharge port section 92 formed a chevron or inverted V shape with its middle 92*a* located at the highest position.

Because the middle discharge port section 92 is formed in such a chevron or inverted V shape with its middle 92*a* located at the highest position, rainwater directed to the middle discharge port section 92 can be directed leftward and rightward as indicated by arrows J. Thus, the rainwater discharged through the middle discharge port section 92 can be bypassed from the electric cable insertion section 55 (see FIG. 2).

Modification 2

Figure 15:
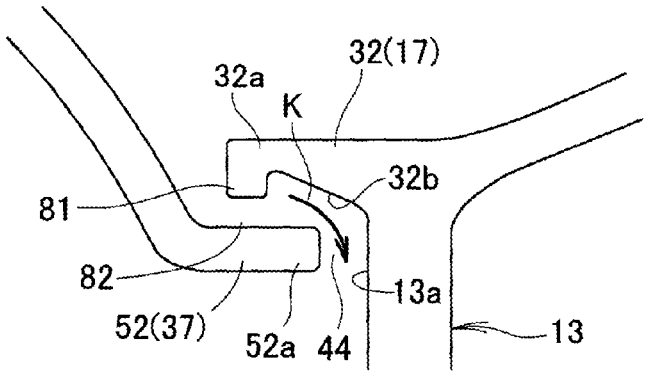
FIG. 15 is a sectional view showing modification 2 in which a lower protruding wall portion has an oblique lower surface.

As shown in FIG. 15, modification 2 is characterized by replacing the lower surface of the lower protruding wall portion 32 with a lower surface 32*b*. Specifically, whereas the lower surface of the lower protruding wall portion 32 in the above-described embodiment extends substantially horizontally, the lower surface 32*b* of the lower protruding wall portion 32 in modification 2 extends obliquely.

More specifically, the lower surface 32*b* of the lower protruding wall portion 32 is formed to extend in a downward slope from the downward projection 81 to the surface 13*a* of the case 13. Thus, rainwater adhered to the lower surface 32*b* of the lower protruding wall portion 32 can be directed along the lower surface 32*b* to the surface 13*a* of the case 13 as indicated by arrow K. In this way, the rainwater between the lower peripheral wall 52 of the cover 18 and the lower surface 32*b* can be appropriately discharged to the outside through the gap 44.

Modification 3

Figure 16:
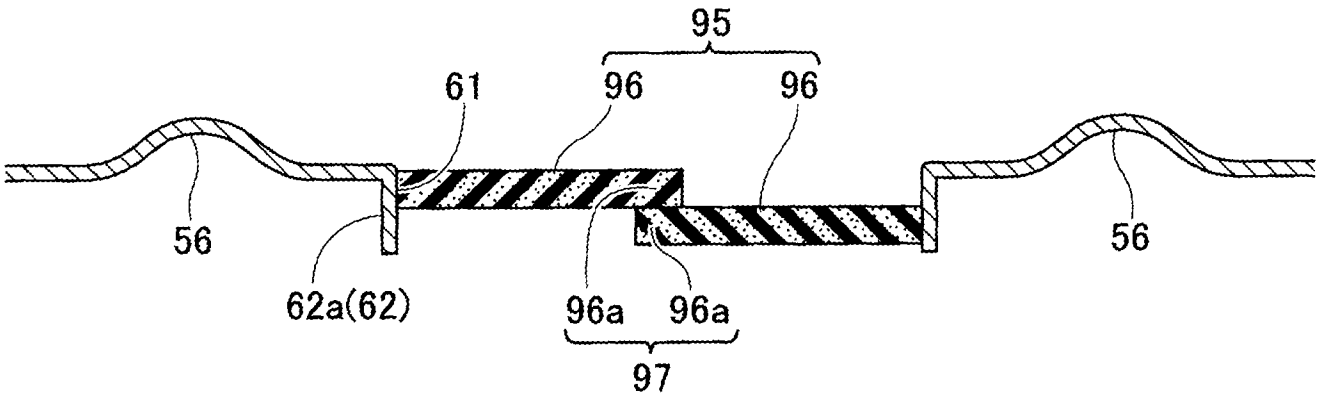
FIG. 16 is a sectional view showing modification 3 in which an electric seal section has a pair of seal members with their respective distal end portions superimposed on each other.

As shown in FIG. 16, modification 3 is characterized by replacing each of the electric cable seal sections 38 with an electric cable seal section 95. Specifically, whereas the electric cable seal section 38 has the slit 47 formed therein for passage therethrough of the electric cable 65 (see FIG. 6), the electric cable seal section 95 includes a pair of seal members 96 superimposed on each other.

More specifically, the electric cable seal section 95 includes the pair of seal members 96 fixed at their respective one ends to the inner surfaces of adjoining ones of the ribs 62 by adhesive or the like. Respective distal end portions 96*a* of the seal members 96 are superimposed on each other to together constitute a superimposed portion 97. Thus, the superimposed portion 97 is reliably closed so that each of the insertion openings 61 can be covered with the pair of seal members 96. Like the electric cable seal sections 38, the seal members 96 are each formed of an elastic material that is generally used as seal members in automobiles.

The seal members 96 are superimposed at their respective distal end portions 96*a* on each other in such a manner that the electric cable 65 can be inserted between and through the distal end portions 96*a* (see FIG. 6), i.e. can be passed through the superimposed portion 97. By the electric cable 65 being inserted between and through the distal end portions 96*a* (i.e., passed through the superimposed portion 97), the seal members 96 elastically deform. The elastic deformation of the pair of seal members 96 can prevent a gap from occurring between the electric cable 65 and the distal end portions 96*a*. In this way, the instant modification can prevent rainwater from entering the electric power takeout section 16 (see FIG. 3) through between the electric cable 65 and the distal end portions 96*a*.

The electric power takeout device 15 of the present invention should not be construed as limited to the above-discussed embodiment and modifications and may be modified various as appropriate. For example, whereas the embodiment has been described above in relation to the case where the electric power supply apparatus 10 is a DC-AC conversion apparatus, the present invention is not so limited, and the electric power supply apparatus 10 may be any other apparatus than the DC-AC conversion apparatus, such as a power generator.

Further, whereas the embodiment of the electric power takeout device 15 has been described above in relation to the case where it is protected from rainwater, the present invention may be applicable to other applications where the electric power takeout device 15 is protected from any other kinds of water than rainwater.

Furthermore, whereas the embodiment of the electric power takeout device 15 has been described above in relation to the case where the water discharge port 57 comprises the middle discharge port section 67, the left discharge port section 68 and the right discharge port section 69, the present invention is not so limited, and the water discharge port 57 may comprises only the middle discharge port section 67.

Furthermore, whereas the embodiment of the electric power takeout device 15 has been described above in relation to the case where the middle guide portion 76 is formed to extend in a downward slope from the upper protruding wall portion 31 toward the middle discharge port section 67, the present invention is not so limited, and the middle guide portion 76 may be formed to extend horizontally.

Furthermore, whereas the embodiment of the electric power takeout device 15 has been described above in relation to the case where the upward projection 59*a* is formed at the distal end 76*a* of the middle guide portion 76, the present invention is not so limited, and the upward projection 59*a* need not necessarily be formed at the distal end 76*a* of the middle guide portion 76.

Moreover, the shapes and constructions of the power supply apparatus, apparatus body, electric power takeout device, protruding wall, cover, output receptacle, upper protruding section, cover wall, peripheral wall of the cover, electric cable seal section, water introduction port, slit, water discharge port, water guide section, upward projection, insertion opening, electric cable, middle discharge port section, middle guide portion, superimposed portion, etc. are not limited to those shown and described above and may be modified as appropriate.

The basic principles of the present invention are well suited for application to an electric power supply apparatus provided in an electric power conversion apparatus and including an electric power takeout device for taking out electric power converted by the electric power conversion apparatus.

What is claimed is:

1. An electric power takeout device for use in a power supply apparatus for taking out electric power from the power supply apparatus, which comprises:

a protruding wall provided on and protruding from a body of the power supply apparatus in such a manner as to surround an electric power takeout section of the electric power takeout device; and a cover covering the protruding wall and the electric power takeout section, the cover including: a cover wall covering the electric power takeout section and having an outer peripheral edge opposed to a distal end edge of the protruding wall; and a peripheral wall protruding from the outer peripheral edge of the cover wall along the protruding wall, the peripheral wall being spaced a given distance from the body to thereby define a water introduction port above the protruding wall, the cover wall having: a water discharge port communicating with the water introduction port and opening beneath the protruding wall; and a water guide section extending from a lower edge of the water discharge port to beneath the protruding wall.

2. The electric power takeout device according to claim 1, wherein the cover wall has a projection projecting from a position of the water guide section, overlapping the protruding wall in a vertical direction, toward the protruding wall.

3. The electric power takeout device according to claim 1, wherein the water guide section extends in a downward slope from the protruding wall toward the water discharge port.

4. The electric power takeout device according to claim 1, wherein the cover wall has an insertion opening formed in a portion thereof corresponding to an electrical receptacle of the electric power takeout device, and the cover includes an elastically deformable, electric cable seal section, the electric cable seal section covering the insertion opening and having a slit or an superimposed portion which an electric cable to be connected to the receptacle can be passed through.

* * * * *